US005931219A

United States Patent [19]

Kull et al.

[11] Patent Number: 5,931,219

[45] Date of Patent: Aug. 3, 1999

[54] PLATE HEAT EXCHANGER

[75] Inventors: Reinhard Kull, Ludwigsburg; Gebhard Schwarz, Stuttgart, both of Germany

[73] Assignee: Behr GmbH & Co., Stuttgart, Germany

[21] Appl. No.: 08/623,994

[22] Filed: Mar. 29, 1996

[30] Foreign Application Priority Data

Mar. 31, 1995 [DE] Germany ..... 195 11 991

[51] Int. Cl.[6] ..... F28F 3/12; F02B 29/04; F02G 5/02

[52] U.S. Cl. ..... 165/51; 165/166; 165/167

[58] Field of Search ..... 165/167, 166, 165/51

[56] References Cited

U.S. PATENT DOCUMENTS

| | | | |
|---|---|---|---|
| 3,631,923 | 1/1972 | Izeki | 165/167 |
| 3,946,804 | 3/1976 | Tkach et al. | 165/167 |
| 4,291,760 | 9/1981 | Argvle et al. | 165/166 |
| 4,327,802 | 5/1982 | Beldam . | |
| 4,872,578 | 10/1989 | Fuerschbach et al. | 165/167 |
| 4,987,955 | 1/1991 | Bergquist et al. | 165/167 |
| 5,174,370 | 12/1992 | Hallgren | 165/167 |
| 5,531,269 | 7/1996 | Dahlgren | 165/167 |

FOREIGN PATENT DOCUMENTS

| | | |
|---|---|---|
| 0 623 798 | 11/1994 | European Pat. Off. . |
| 3 620 754 | 12/1987 | Germany . |
| 4 240 239 | 6/1994 | Germany . |
| 4 331 509 | 7/1994 | Germany . |
| 94 06 197 | 7/1994 | Germany . |
| 4 314 808 | 11/1994 | Germany . |
| 93/25860 | 12/1993 | WIPO . |
| 95/00810 | 1/1995 | WIPO . |

OTHER PUBLICATIONS

GB 9602331.2 U.K. Search Report, Apr. 18, 1996.

*Primary Examiner*—John K. Ford
*Attorney, Agent, or Firm*—Foley & Lardner

[57] ABSTRACT

A plate heat exchanger comprises a plurality of heat exchanger plates stacked one above the other. The plates each have a peripheral edge projecting from its plate plane. The heat exchanger plates succeeding one another in each case are sealingly connected at their edges, so that flow ducts for at least two heat exchange media form between the plates. Each of these flow ducts is connected via openings in the heat exchanger plates to at least one other flow duct, so that a first heat exchange medium can flow through a first group of ducts loaded in parallel and a second heat exchange medium can flow through another group. So that a heat exchanger constructed in this way offers a satisfactory heat transmission capacity even in the case of widely varying volume flows of the media involved, the openings for the first heat exchange medium have a substantially larger cross section than the openings for the second heat exchange medium.

13 Claims, 2 Drawing Sheets

PLATE HEAT EXCHANGER

BACKGROUND OF THE INVENTION

The invention relates to a stacked type plate heat exchanger. A German patent publication DE 4 314 808 A1, for example, discloses a plate heat exchanger designed as an oil/coolant cooler. This plate heat exchanger comprises a multiplicity of trough-shaped heat exchanger plates stacked one on top of the other. The peripheral edges of the exchanger plates bear on one another and are sealingly soldered together. At the same time, all the heat exchanger plates have the same shape. Flow ducts are formed between the plates, one flow duct being assigned to an oil circuit and another flow duct to a coolant circuit, alternately in each case. Provided in the heat exchanger plates are recesses or openings, through which the heat exchanger media are supplied or are conveyed further to the following flow ducts.

This known plate heat exchanger is designed on the principle of identical parts and is therefore extremely simple in construction and cost-effective in production. In view of the identical design of the throughflow cross sections and the absolutely identical type and number of the respective flow ducts, a sufficient heat transmission capacity is afforded only when the mass flow and volume flow of the two heat exchanger media are approximately the same. This is the case, for example, when the plate heat exchanger is used as an oil/coolant cooler.

SUMMARY OF THE INVENTION

The present invention accordingly is drawn to a plate heat exchanger particularly suitable for widely differing volume flows of at least two heat exchanger media. According to the present invention, the plate heat exchanger comprises a plurality of heat exchanger plates stacked one next to the other. Each of these exchanger plates defines a plate plane and a peripheral edge projecting from the plate plane. The stacked heat exchanger plates are sealingly connected at their edges. According to the present invention, a plurality of first and second flow ducts are formed between the exchanger plates for conveying at least first and second heat exchange media respectively, such as an intake air and engine coolant of an internal combustion engine, or an exhaust-gas of an internal combustion engine and a heating medium, such as an engine coolant or air, for a heating circuit, where the heat from the exhaust gas can be recovered through the heating medium.

A plurality of first and second fluid communication openings are formed in each of the heat exchanger plates, where the first flow ducts communicate with each other via the first openings and the second flow ducts communicate with each other via the second openings. The first flow ducts are assigned to transmit the first medium through the first openings and the second flow ducts are assigned to transmit the second medium through the second openings. At least one connection plate each having communication ports for supplying and discharging the heat exchange media is connected to the exchanger plates. The first openings for the first medium have a substantially larger cross section than the second openings for the second medium. Preferably, the cross section of the first openings is approximately four to five times the cross section of the second openings. Further preferably, there are more of the first ducts than the second ducts.

According to one aspect of the present invention, the first and second ducts are stacked, with the first and second ducts successively alternating. Specifically, the first and second stacked ducts are successively alternating with two of the first flow ducts followed by one of the second flow ducts. Preferably, the height of the first flow ducts is preferably larger than the height of the second flow ducts by ratio of 3:1.

The plate heat exchanger further includes a plurality of turbulence inserts provided in each of the first and second duct. Sealing disks are seated around one of the first and second openings of each of the exchanger plates, between the plates in the flow ducts to block and form passageways for the respective media. Alternatively, sealing sleeves and sealing disks can be seated around the first and second openings, between the plates and in the flow ducts to block and form passageways for the respective media. Preferably, the sleeves and disks each have means for concentrically seating over the respective openings, such as an axial collar.

The plate heat exchanger can include an assembly plate for connecting the exchanger to a load-bearing structure. All of the communication ports can be arranged on the connection plate. According to another aspect of the present invention, there are two connection plates each with at least two communication ports. One of the connection plates is connected to an uppermost stack of the exchanger plates and the other of the connection plate is connected to a bottom-most stack of the exchanger plates. The communication portions for the first and second media are formed on each of the connection plates.

According to another aspect of the present invention, the plate heat exchanger can be used for cooling an exhaust gas of an internal combustion engine, where the cooled exhaust gas is fed to an air intake.

BRIEF DESCRIPTION OF THE DRAWINGS

These and other features, aspects, and advantages of the present invention will become much more apparent from the following description, appended claims, and accompanying drawings where:

DETAILED DESCRIPTION OF THE PREFERRED EMBODIMENTS

Figure 1:
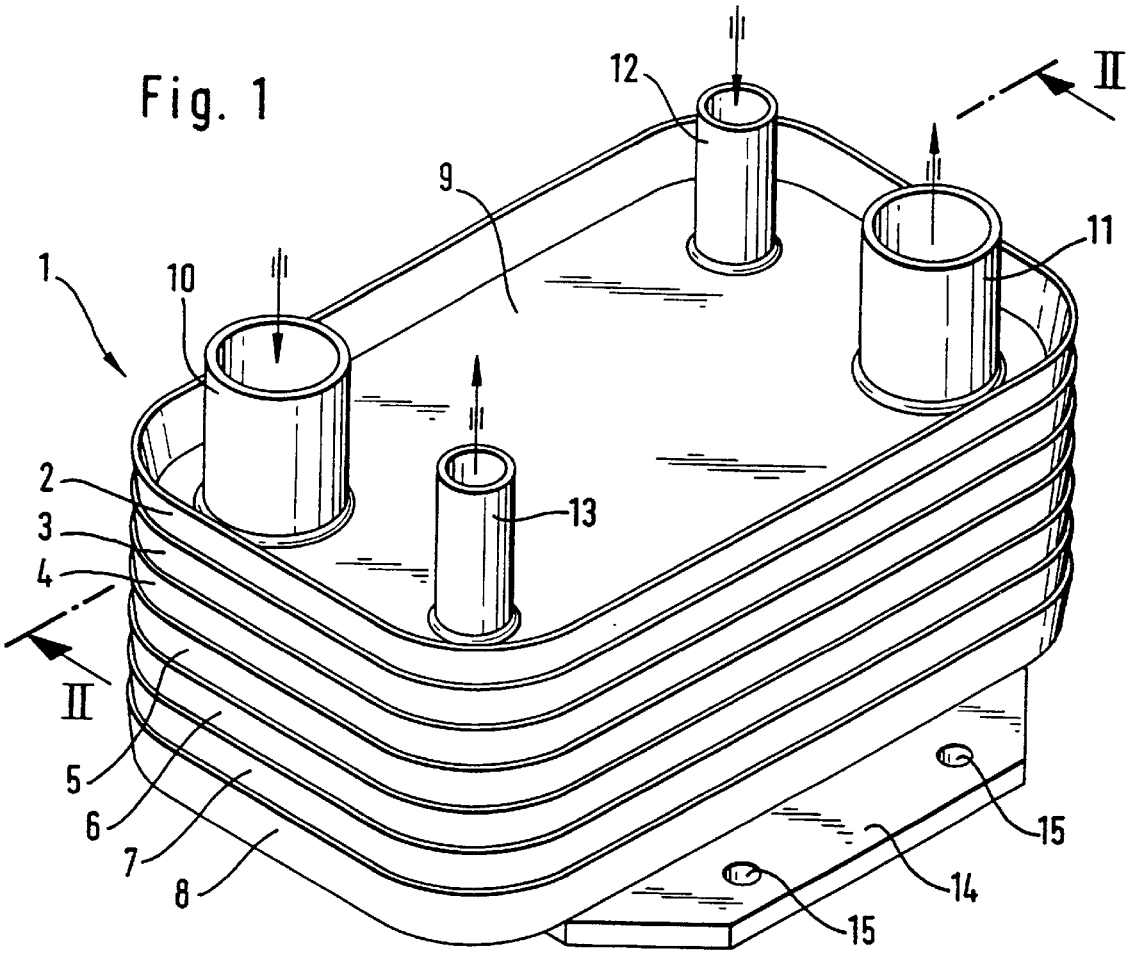
FIG. 1 is a perspective view of a plate heat exchanger.

FIG. 1 shows a plate heat exchanger 1, which comprises a plurality of plates 2 to 8 stacked one on top of the other. Arranged on the top side of the plate heat exchanger 1 is a connection plate 9, to which connection pieces or communication ports 10 and 11 for a first heat exchanger medium, preferably gaseous, and connection pieces or communication ports 12 and 13 for a second heat exchanger medium, preferably liquid, are fastened. The ports 10, 11 for the gaseous medium have a substantially larger cross section than the ports 12, 13 for the liquid medium. In each case, one of the communication ports is provided as a supply port 10, 12 and the other as a discharge port 11, 13. The arrangement of the ports 10, 11, 12, and 13 is such that the supply ports 10, 12 and the respective associated discharge ports 11, 13 are located diagonally opposite each other and the directions of flow of the two media are opposite to one another. Arranged on the underside of the plate heat exchanger 1 is an assembly plate 14 with bores 15, which plate serves for fastening the plate heat exchanger 1 to a load-bearing structural part.

Figure 2:
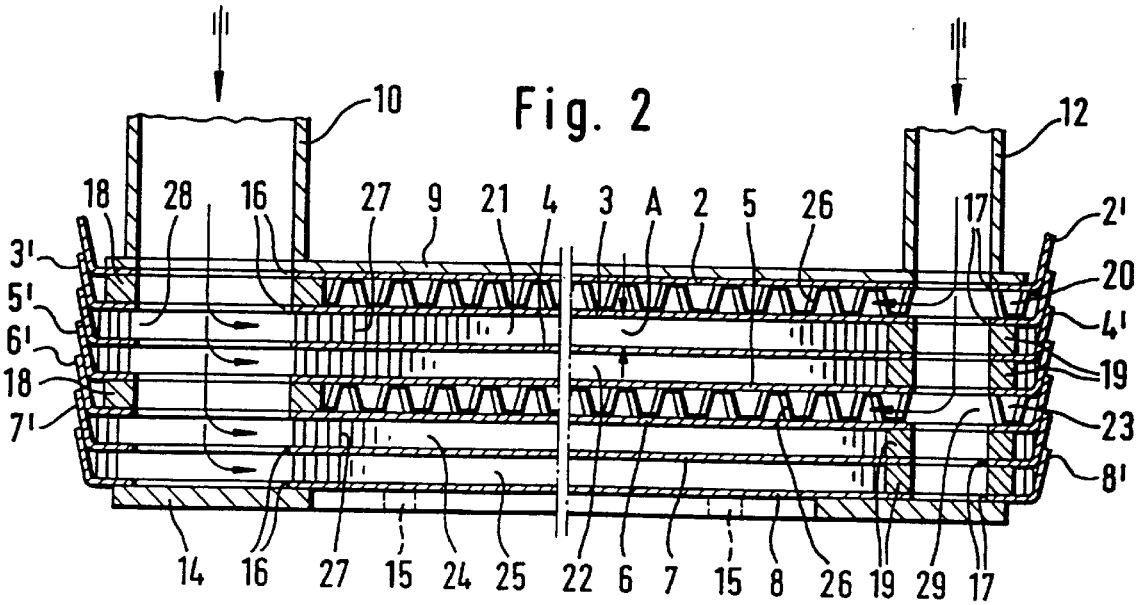
FIG. 2 is a cross-sectional view taken along the line II—II in FIG. 1.

FIG. 2 shows a section taken along the line II—II of FIG. 1 on an enlarged scale. The plates 2–8 are of trough-shaped design, so that they each have a peripheral edge 2'–8' projecting from their plate planes, the edges 2'–8' being arranged at the same angle and being higher than a clearance A relative to the plates 2–7 located above. In this way, the edges 2'–8' of the respective adjacent plates 2–8 overlap one another. In the overlap region, the edges are connected, for example by soldering, in a gas-tight or liquid-tight manner. Formed in each case between two adjacent plates 2–8 are flow ducts 20–25 having the same flow cross section on account of the uniform clearance A in each case between two adjacent plates 2–8.

The plates 2–8 are shaped identically and are provided with circular recesses or openings 16 of a larger (first) diameter and recesses or openings 17 of a smaller (second) diameter. In each case, the first openings 16, on the left in FIG. 2, and the second openings 17, on the right in FIG. 2, are located congruently one above the other. Arranged in the flow duct 20 formed between the plates 2 and 3 is a disk 18, the inside diameter of which corresponds to that of the openings 16. The disk 18 is soldered to the plates 2 and 3 and thus forms a passage duct for the first medium, for example the supercharging air of an internal combustion engine, from the supply port 10, which is fastened to the connection plate 9, to the flow ducts 21 and 22 formed between the plates 3, 4 and 4, 5. A further disk 18 is arranged between the plates 5 and 6 and is connected in the same way, so that the first medium supplied through the port 10 also arrives at the flow ducts 24 and 25.

Provided in the region of the second openings 17, between the plates 3, 4 and 4, 5, are disks 19 with their inside diameters corresponding to those of the second openings 17. An identical arrangement of the disks 19 is located between the plates 6, 7 and 7, 8. While the disks 19 between the plates 3, 4 and 4, 5 form a passage duct for the second medium, for example a coolant of an internal combustion engine, supplied from the supply port 12 to the flow duct 23, the disks 19 between the plates 6, 7 and 7, 8 serve merely for sealing off relative to the flow ducts 24 and 25. It emerges from FIG. 2 that the first medium can flow through the flow ducts 21, 22, 24 and 25 in parallel, while the second medium can flow through the remaining flow ducts 20 and 23 in the opposite direction.

Turbulence inserts 26 and 27 are arranged in the flow ducts 20–25 and are soldered to the heat exchanger plates 2–8, thereby improving the heat transmission and increasing the strength of the plate heat exchanger 1. The turbulence inserts 26 and 27 are designed differently; the turbulence inserts 27 are provided in the flow ducts 21, 22, 24 and 25 assigned to the supercharging-air flow, whereas the turbulence inserts 26 are provided in the flow ducts 20, 23 assigned to the coolant. So that the turbulence insert does not impede the flow to subsequent flow ducts in the region of the openings 16 or 17, the turbulence inserts 26 and 27 are provided with corresponding recesses or openings 28 and 29. These openings 28 and 29 can have such a size that the disks 18 and 19 are received in them, so that the disks are held exactly in position before the soldering of the plate heat exchanger 1. Located on the underside of the plate stack is the assembly plate 14, which serves at the same time to close the openings 16 and 17 of the bottommost plate 8.

In addition to the relative arrangement of the flow ducts shown in FIG. 2, other arrangements can also be implemented, for example by means of three parallel flow ducts for the first medium and one flow duct for the second medium. In an arrangement of this kind, however, the plates forming the middle duct should be provided with orifices to the respectively adjacent flow ducts, so that an overflow of the first medium from the middle flow duct to the adjacent flow ducts, and vice versa, is possible.

Figure 3:
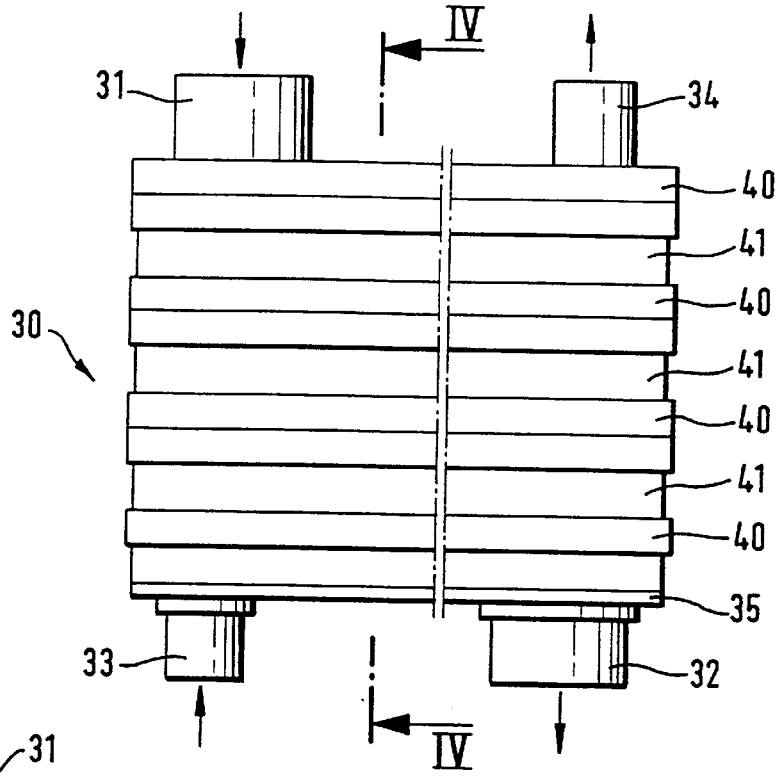
FIG. 3 is a side view of a plate heat exchanger with fluid communication ports on the topside and the underside.

FIG. 3 shows a side view of a plate heat exchanger 30 provided on the top side with an supply communication port 31 for the first medium and with a discharge communication port 34 for the second medium. Located on the underside of the plate heat exchanger 30 is a connection plate 35, on which a supply communication port 33 for the second medium and a discharge communication port 32 for the first medium are provided. The plate heat exchanger 30 comprises a plurality of alternating plates 40 and 41, the plates 41 having edges 41' with a substantially larger height than that of the edges 40' of the plates 40. Thus, in the plate stack, a flow duct 40 assigned to the second medium and a flow duct 41 assigned to the first medium succeed one another alternately in each case, the second medium being capable of flowing through the respectively uppermost and bottommost flow ducts. Flow ducts having a large flow cross section are formed by the higher edges 41' of the plates 41.

Figure 4:
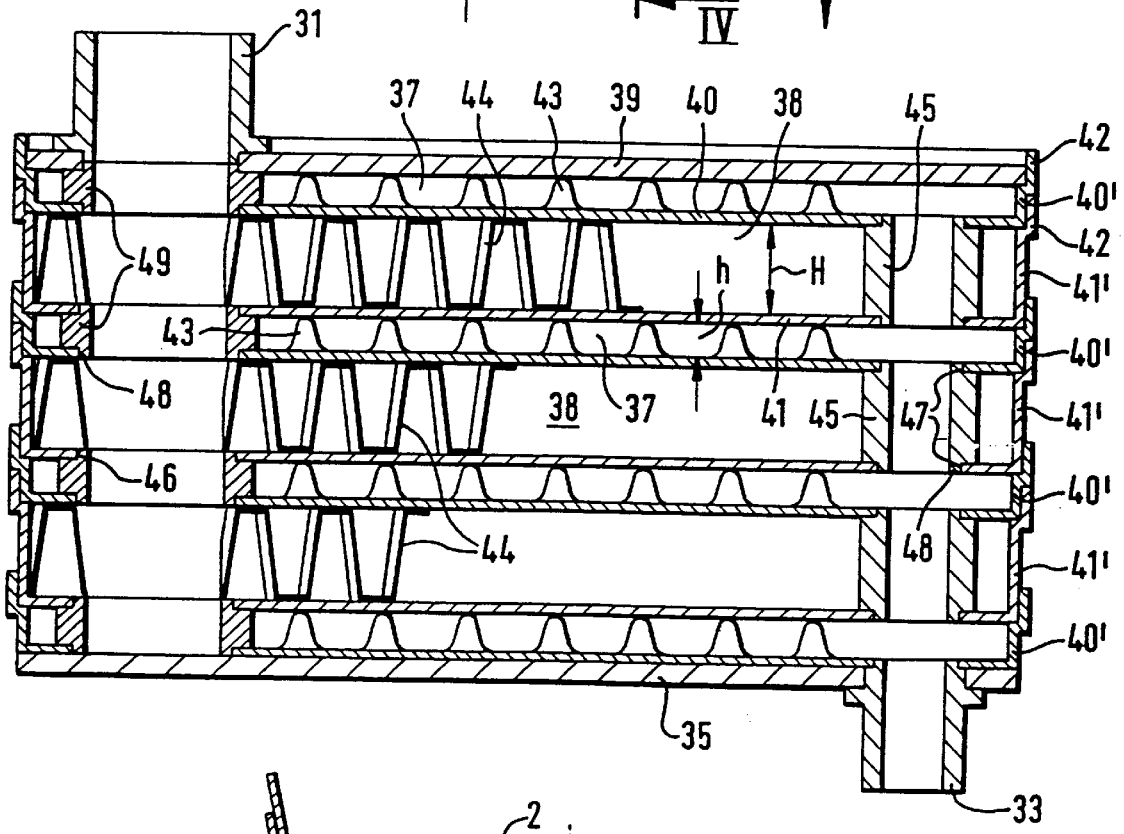
FIG. 4 is a cross-sectional view taken along the line IV—IV of FIG. 3 on an enlarged scale.

FIG. 4 shows a cross-section taken along the line IV–IV of FIG. 3 on an enlarged scale. It is evident from this representation that the sidewalls 40 and 41 of the heat exchanger plates 40 and 41 extend at right angles to the plate plane and have different heights. The heat exchanger plates 40 and 41 can be stacked one above the other in each case by means of a radially widened portion 42 of the edges 40' and 41', the respective clearance between two successive plates 40 and 41 being determined by the height h of the edge 40' and the height H of the edge 41'. This results in flow ducts 37 and 38 having widely differing flow cross sections, and any ratio of the flow cross sections can be determined as a function of the respective heights h and H. In the exemplary embodiment shown, the ratio of the heights H:h is about 3:1.

A connection plate 39, on which the supply port 31 is located, is arranged above the uppermost heat exchanger plate 40. Provided underneath the supply port 31, in all the plates 40 and 41, are first recesses or openings 46, which have a substantially larger diameter than second recesses or openings 47 on the other side of the plates 40, 41. The heat exchanger plate 40 has embossed elevations 43, which serve, on one hand, as turbulence generators and, on the other hand, for maintaining a predetermined distance between the connection plate 39 and heat exchanger plate 40. A flow duct 37 for the second medium is formed between the connection plate 39 and the heat exchanger plate 40. In order to separate the first medium from the flow duct 37, in the region of the port 31 a disk 49 is provided between the connection plate 39 and the plate 40 as a passage duct for the first medium. A flow duct 38 for the first medium is formed between the heat exchanger plates 40 and 41. On account of the substantially larger height H, the passage duct for the second medium is formed by a sleeve 45 in the flow ducts 38. Since no turbulence inserts are provided in the flow ducts 37, the exact position of the disks 49 is to be guaranteed in a way other than that shown in FIG. 2. For this purpose, axially projecting collars 48 are provided on the end faces of the disks 49, which collars reach into the first openings 46. The sleeves 45 can be designed and fixed in this way. Located in the flow duct 38 is a turbulence insert 44, the height of which corresponds to the clearance between the plates 40 and 41. Additional plates 40 and 41 then follow in a regularly recurring manner as far as the lower connection plate 35.

Figure 5:
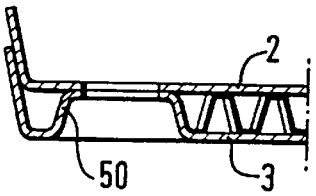
FIG. 5 shows details of the connection plate.

FIG. 5 shows a detail of two stacked plates 2, 3, which lie one on top of the other and in which embossings 50 of the plate 3 are provided instead of the sleeves. These embossings 50 reach as far as the plate 2 and are sealingly connected to the latter, for example by soldering.

For reasons of weight, the plate heat exchanger 1 or 30 is preferably produced from aluminum materials. Depending on the intended use, for example, when there is loading with aggressive media, the heat exchanger should be composed of high-grade steel, as is the case particularly in use in exhaust-gas systems.

The essential advantages of the invention are to be seen in that, while maintaining a simple construction, the use of the heat exchanger is suitable even for extremely varying volume flows involving two heat exchanger media, such as, for example, in a supercharging-air/coolant cooler and an exhaust-gas/heating-medium heat exchanger. The plate heat exchanger may be used likewise advantageously for exhaust-gas cooling in exhaust-gas recycling systems.

According to one preferred aspect of the present invention, the throughflow cross section of the first openings for the first medium is approximately four to five times the throughflow cross section of the second openings for the second medium. The pressure loss for the first medium is thereby kept low. Insofar as the plate heat exchanger comprises identical heat exchanger plates, the diversity of parts is reduced to a minimum. It is advantageous to provide a larger number of flow ducts for the first medium than for the second medium. In this way, a larger flow cross section in the plate stack is achieved for the first medium than for the second medium. At the same time, it is considered particularly expedient to have an arrangement where two flow ducts for the first medium follow one flow duct for the second medium, to double the flow cross section for the first medium.

According to another aspect of the present invention, a flow duct for the first medium and a flow duct for the second medium are arranged in each case alternately in succession. At the same time, the height of the flow ducts for the first medium is substantially larger than the height of the flow ducts for the second medium, the ratio of the heights preferably being 3:1. As a result of this design, virtually any desired ratio of the respective flow cross sections can be implemented. That is, the flow cross section for the first medium need not only be integral multiples of the flow cross section for the second medium.

There are several design possibilities with regard to the position of the communication ports for the two heat exchange media. Thus, for example, all the communication ports can be arranged on a common connection plate and an assembly plate can be provided at the other end of the plate stack. Such an assembly plate makes it possible to simply fasten the plate heat exchanger to a load-bearing structural part or, if appropriate, also directly to a vehicle engine. So that the length of the flow path through the heat exchanger is not determined by the particular position of the individual flow duct, but is the same for all the flow ducts, two connection plates are provided, namely one on the topside and one on the underside of the plate stack, and a connection for the first medium and the second medium is arranged in each case on each of the connection plates. The direction of throughflow of the two media is, at the same time, such that, on a connection plate, there is a supply for the first medium and a discharge for the second medium, and vice versa.

Arranged in the region of the openings, between the plates, are sleeves and/or disks, by means of which passage ducts for the other respective medium are formed in a flow duct. In this case, sleeves for bridging the larger height in the flow ducts for the first medium and disks for use in the flow ducts having the smaller height are provided. The exact positioning of the sleeves or disks can take place, for example, by means of corresponding orifices in a turbulence insert, so that the bores in the disks or sleeves are congruent with the openings in the heat exchanger plates. Insofar as the turbulence inserts do not extend into the edge region of each flow duct, where the openings of the heat exchanger plates are provided, or in the case of the arrangement of other turbulence-generating means which are, for example, made in one piece with the heat exchanger plate, it is expedient for the sleeves and/or disks have means for concentrically arranging over the openings. Such a means can, for example, comprise an axial pin or collar on the end face of the sleeves or disks. Alternatively to the arrangement of sleeves, a design of plates with corresponding embossings can also be provided, the sleeves in each case reaching to the next plate and being sealingly connected to thereto.

A preferred use of the plate heat exchanger according to the present invention is seen in that the supercharging air for an internal combustion engine, preferably in a motor vehicle, flows through the flow ducts for the first medium and the coolant of this internal combustion engine flows through the flow ducts for the second medium. An extremely compact supercharging-air cooler with a high heat transmission capacity is thereby achieved. In comparison with known coolant-cooled supercharging-air coolers, an appreciable advantage is to be seen in that there is no need for any air boxes for distributing the supercharging air to the individual pipe elements. Whereas, in known coolant-cooled supercharging-air coolers, so-called water hammers can occur in the engine as a result of leaks, this risk is negligibly small in the plate heat exchanger according to the present invention since the connection of the disks or sleeves to the heat exchanger plates is extremely reliable and, at most, a leak may occur in the edge region of the heat exchanger plates. However, this in no way results in a water hammer, since coolant at most passes outwardly, but not into the supercharging-air stream.

A further expedient use of the plate heat exchanger is seen in that the flow ducts for the first medium are connected to an exhaust-gas conduit of an internal combustion engine in a motor vehicle. The other flow ducts are loaded by the heating medium of the vehicle heating, which can at the same time be the coolant of this internal combustion engine. The plate heat exchanger thus serves for recovering the heat present in the exhaust gas. The recovery of the exhaust-gas heat is important particularly in those drives that are optimized in terms of consumption, which drives therefore produce less lost heat utilized for heating purposes in the motor vehicle. Furthermore, the timespan for reaching a predetermined operating temperature of the internal combustion engine is reduced. So that a catalyzer present in the exhaust-gas conduit is not adversely affected by this heat recovery, the plate heat exchanger should be located downstream of the catalyzer arrangement in the exhaust-gas conduit. Moreover, the use of the plate heat exchanger in exhaust-gas systems for cooling the exhaust gas returned to the internal combustion engine is possible.

Given the disclosure of the present invention, one versed in the art would readily appreciate the fact that there may be other embodiments and modifications well within the scope and spirit of the present invention. Accordingly, all expedient modifications readily attainable by one versed in the art from the present disclosure within the scope and spirit of the present invention are to be included as further embodiments of the present invention. The scope of the present invention accordingly is to be defined as set forth in the appended claims.

We claim:

1. A plate heat exchanger for cooling intake air for an internal combustion engine with liquid coolant comprising:

a plurality of heat exchanger plates stacked one next to the other, each of the exchanger plates having a plate plane and a peripheral edge projecting from the plate plane, the stacked heat exchanger plates being sealingly connected at their edges;

a plurality of first flow ducts formed between the exchanger plates for transmitting the intake air;

a plurality of second flow ducts formed between the exchange plates for transmitting the liquid coolant;

a plurality of first and second fluid communication openings formed in each of the heat exchanger plates, wherein the first flow ducts communicate with each other via the first openings and transmit the intake air therethrough and the second flow ducts communicate with each other via the second openings and transmit the liquid coolant therethrough; and at least one connection plate each having communication ports for supplying and discharging the intake air and the liquid coolant, wherein the first openings for the intake air have a substantially larger cross section than the second openings for the liquid coolant, wherein a cross-sectional area of the first flow ducts is substantially larger than a cross-sectional area of the second flow ducts, and wherein the first and second ducts are stacked, successively alternating with two of the first flow ducts followed by one of the second ducts.

2. The heat exchanger according to claim 1, wherein the cross section of the first openings is approximately four to five times the cross section of the second openings.

3. The plate heat exchanger according to claim 1, wherein the number of the first ducts is larger than the number of the second ducts.

4. The plate heat exchanger according to claim 1, further comprising an assembly plate for connecting the exchanger to a load-bearing structure, wherein all of the communication ports are arranged on the connection plate.

5. The plate heat exchanger according to claim 1, further comprising a plurality of turbulence inserts in each of the first and second ducts.

6. The plate heat exchanger according to claim 1, further comprising sealing disks seated around one of the first and second openings of each of the exchanger plates, between the plates in the flow ducts to block and form passageways for the intake air and the liquid coolant.

7. The plate heat exchanger according to claim 1, wherein the liquid coolant is an engine coolant of the internal combustion engine.

8. A plate heat exchanger comprising:

a plurality of heat exchanger plates stacked one next to the other, each of the exchanger plates having a plate plane and a peripheral edge projecting from the plate plane, the stacked heat exchanger plates being sealingly connected at their edges;

a plurality of first and second flow ducts formed between the exchanger plates for transmitting at least first and second heat exchange media respectively;

a plurality of first and second fluid communication openings formed in each of the heat exchanger plates, wherein the first flow ducts communicate with each other via the first openings and the second flow ducts communicate with each other via the second openings, wherein the first flow ducts are assigned to transmit the first medium through the first openings and the second flow ducts are assigned to transmit the second medium through the second openings; and at least one connection plate each having communication ports for supplying and discharging the heat exchange media, wherein the first openings for the first medium have a substantially larger cross section than the second openings for the second medium, wherein the number of the first ducts is larger than the number of the second ducts, and wherein the first and second ducts are stacked, successively alternating with two of the first flow ducts followed by one of the second flow ducts.

9. The plate heat exchanger according to claim 8, wherein the first medium is an exhaust-gas of a motor vehicle internal combustion engine and the second medium is a heating medium for a heating circuit of the vehicle, which exhaust-gas heats the heating medium.

10. The plate heat exchanger according to claim 9, wherein the heating medium is an engine coolant.

11. The plate heat exchanger according to claim 8, wherein the first medium is an exhaust-gas of an internal combustion engine and the second medium is a coolant, which cools the exhaust-gas.

12. A plate heat exchanger comprising:

a plurality of heat exchanger plates stacked one next to the other, each of the exchanger plates having a plate plane and a peripheral edge projecting from the plate plane, the stacked heat exchanger plates being sealingly connected at their edges;

a plurality of first and second flow ducts formed between the exchanger plates for transmitting at least two different media;

a plurality of first and second fluid communication openings formed in each of the heat exchanger plates, wherein the first flow ducts communicate with each other via the first openings and the second flow ducts communicate with each other via the second openings, wherein the first flow ducts are adapted to transmit exhaust gas of an internal combustion engine through the first openings the second flow ducts are adapted to transmit liquid coolant through the second openings; and at least one connection plate each having first and second communication ports for supplying and discharging the exhaust gas and the coolant, wherein the exhaust gas is introduced to the first supplying communication port and discharged to the first discharging communication port and to an air intake of the engine, wherein the first openings for the exhaust gas have a substantially larger cross section than the second openings for the coolant, wherein a cross-sectional area of the first flow ducts is substantially larger than a cross-section area of the second flow ducts, wherein the number of the first ducts is larger than the number of the second ducts, and wherein the first and second ducts are stacked, successively alternating with two of the first flow ducts followed by one of the second flow ducts.

13. The plate heat exchanger according to claim 12, wherein the number of the first ducts is larger than the number of the second ducts and wherein the first and second ducts are stacked, successively alternating with two of the first flow ducts followed by one of the second flow ducts.

* * * * *